United States Patent [19]

Ohtsubo et al.

[11] Patent Number: 4,604,887

[45] Date of Patent: Aug. 12, 1986

[54] DUPLEX STAINLESS STEEL SEAMLESS PIPE AND A METHOD FOR PRODUCING THE SAME

[75] Inventors: Hiroshi Ohtsubo, Aichi; Isao Takada, Chita; Tatsuo Kawasaki, Yotsukaido, all of Japan

[73] Assignee: Kawasaki Steel Corporation, Kobe, Japan

[21] Appl. No.: 676,639

[22] Filed: Nov. 30, 1984

[51] Int. Cl.[4] ..... B21B 3/02

[52] U.S. Cl. ..... 72/368; 148/12 E; 148/12 EA

[58] Field of Search ..... 148/12 E, 12 EA; 72/68, 72/97, 368, 700

[56] References Cited

U.S. PATENT DOCUMENTS

| | | | |
|---|---|---|---|
| 2,264,455 | 12/1941 | Peck | 72/68 |
| 2,274,579 | 2/1942 | Bannister et al. | 72/97 |
| 3,689,325 | 9/1972 | Hayden, Jr. et al. | 148/12 E |

FOREIGN PATENT DOCUMENTS

| | | | |
|---|---|---|---|
| 193319 | 11/1983 | Japan | 148/12 EA |
| 80716 | 5/1984 | Japan | 72/97 |
| 182918 | 10/1984 | Japan | 148/12 EA |

*Primary Examiner*—Lowell A. Larson

*Attorney, Agent, or Firm*—Balogh, Osann, Kramer, Dvorak, Genova & Traub

[57] ABSTRACT

A duplex stainless steel seamless pipe can be inexpensively produced in high productivity and yield without causing cracks during the working steps in the plug mill process by a proper combination of the composition of the steel and the working conditions of a billet and a hollow piece for the production of the pipe.

2 Claims, 2 Drawing Figures

DUPLEX STAINLESS STEEL SEAMLESS PIPE AND A METHOD FOR PRODUCING THE SAME

BACKGROUND OF THE INVENTION (1) Field of the Invention

The present invention relates to a duplex stainless steel seamless pipe and a method for producing the same, and more particularly, relates to a method capable of producing inexpensively a duplex stainless steel seamless pipe in high productivity and yield.

(2) Description of Prior Art

Duplex stainless steel represented by JIS SUS 329J1 has high resistances against corrosion, stress corrosion cracking and grooving corrosion, and a high weldability, and has been noticed as a material for piping in various chemical plants, for pipe for oil well, for pipe for subterranean, for line pipe and the like.

Stainless steel seamless pipe is generally produced by plug mill process, mandrel process, pilgar mill process, Ugine.Séjournet process, Ehrhardt-Verfahren mill process and the like.

Duplex stainless steel has a ferrite-austenite duplex texture, and is poor in hot workability. Therefore, hot extrusion methods such as Ugine-Séjournet process and the like have hitherto been used in the production of seamless pipe from stainless steel having a poor hot workability.

However, in the direct piercing method by a hot extrusion method, when the length of a billet becomes as large as 5–7 times the diameter thereof during the piercing, the deviation of the wall thickness of the billet becomes large, and hence it is difficult to produce a continuous length pipe. In order to solve this problem, a continuous length pipe is produced by a so-called expansion method, wherein a hole has previously been bored through a billet at its center by the machining, and the bore is expanded. However, even in this expansion method, the length of a billet is limited to not more than about 15 times the diameter of the billet.

In the Ugine-Séjournet process, a vitreous lubricant is used, and therefore a step for peeling the vitreous lubricant from a rolled hollow piece is necessary. This step is a troublesome step.

SUMMARY OF THE INVENTION

The object of the present invention is to solve the above described drawbacks of the conventional technics and to provide a duplex stainless steel seamless pipe having a continuous length, and a method for producing the pipe in a high productivity.

The above described object of the present invention can be attained by the following three aspects of this invention.

The first aspect of the present invention lies in a duplex stainless steel seamless pipe produced by a plug-mill process, and having a composition consisting of, in % by weight, C: not more than 0.03%, Si: not more than 2.00%, Mn: not more than 2.00%, Cr: 20.0–30.0%, Ni: 1.0–9.0%, Cu: not more than 3.0%, Mo: 0.5–5.0%, N: 0.05–0.30%, Al: 0.01–0.10%, S: not more than 0.004%, P: not more than 0.030%, at least one of Ca: (1–10)×[%S] and B: 0.0005–0.010%; and the remainder being Fe and incidental impurities.

The second aspect of the present invention lies in a method for producing a duplex stainless steel seamless pipe, which has the same composition as that defined in the first aspect of the present invention, by a plug mill process comprising a piercing step by means of a piercing mill, a cross rolling step by means of a cross rolling mill, a rolling step by means of a plug mill, a reeling step by means of a reeler and an outer diameter reducing step by means of a sizer, wherein a billet is pierced in the piercing step under a condition that the billet is kept at a temperature of 1,200°–1,350° C. in its center portion and at a temperature of 1,100°–1,350° C. in its outer surface portion; the cross rolling of the resulting hollow piece is finished at a temperature not lower than 1,100° C. in the cross rolling step; and the cross rolled hollow piece is worked in the plug mill rolling step, in the reeling step and in the outer diameter reducing step under conditions that the equivalent strains which will be caused in the hollow piece in the plug mill rolling step, in the reeling step and in the outer diameter reducing step are keep to not higher than 0.5, not higher than 0.4 and not higher than 0.2 respectively, said equivalent strains being calculated by the following formula (1) and that the total amount of the equivalent strain which will be caused in the hollow piece in the above described plug mill rolling step and in the reeling step is kept to not higher than 0.6, said total amount of the equivalent strain being calculated by the following formula (2):

$$\bar{\epsilon} = \frac{2}{\sqrt{3}} \sqrt{(\epsilon_t^2 + \epsilon_t \cdot \epsilon_B + \epsilon_B^2)} \quad (1)$$

wherein $\epsilon_t = \ln (t/t_o)$ $\epsilon_B = \ln (D/D_o)$ $t_o$, $D_o$: average wall thickness and average outer diameter of the hollow piece before rolling in each step, respectively t, D: average wall thickness and average outer diameter of the hollow piece after rolling in each step, respectively; and $$\bar{\epsilon'} = \frac{2}{\sqrt{3}} \sqrt{(\epsilon_t'^2 + \epsilon_t' \cdot \epsilon_B' + \epsilon_B'^2)} \quad (2)$$

wherein $\epsilon'_t = \ln (t_p/t_{po}) + \ln (t_R/t_{Ro})$ $\epsilon'_B = \ln (D_p/D_{po}) + \ln (D_R/D_{Ro})$ $t_p$, $t_{po}$: average wall thicknesses of the hollow piece after and before rolling by the plug mill, respectively $t_R$, $t_{Ro}$: average wall thicknesses of the hollow piece after and before rolling by the reeler, respectively $D_p$, $D_{po}$: average outer diameters of the hollow piece after and before rolling by the plug mill, respectively $D_R$, $D_{Ro}$: average outer diameters of the hollow piece after and before rolling by the reeler, respectively The third aspect of the present invention lies in a method for producing a duplex stainless steel seamless pipe, which has the same composition as that defined in the first aspect of the present invention, by a plug mill process, wherein a billet is pierced in the piercing step under a condition that the billet is kept at a temperature of 1,200°–1,350° C. in its center portion and at a temperature of 1,100°–1,350° C. in its outer surface portion; the cross rolling of the resulting hollow piece is finished at a temperature not lower than 1,100° C. in the cross rolling step; the cross rolled hollow piece is worked in the plug mill rolling step and in the reeling step under a condition that the equivalent strains which will be caused in the hollow piece in the plug mill rolling step and in the reeling step and are calculated by the above described formula (1) are kept to not higher than 0.5 and not higher than 0.4, respectively; the reeled hollow piece is reheated at a temperature of 850°-1,200° C. for a period of not longer than 10 minutes; and the reheated hollow piece is worked in the outer diameter reducing step under a condition that the equivalent strain which will be caused in the hollow piece in the step and is calculated by the above described formula (1) is kept to not higher than 0.4.

DESCRIPTION OF THE PREFERRED EMBODIMENT

Figure 1:
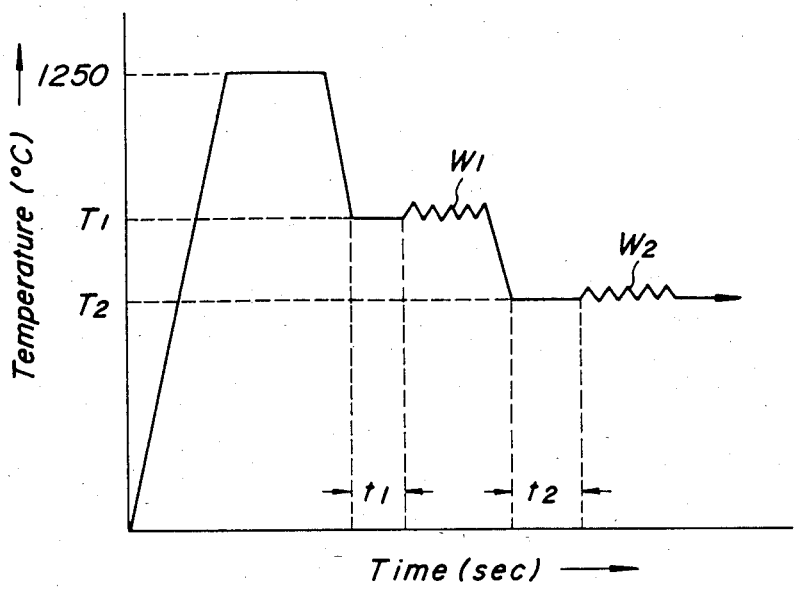
FIG. 1 is a diagram illustrating a working schedule of a test piece in a hot tensile test in the present invention.

The inventors have investigated the chemical composition and rolling condition of a duplex stainless steel in order to produce a duplex stainless steel seamless pipe through the plug mill process having various merits, and found out that the pipe can be produced without forming surface defect and failure of the top and bottom ends by a proper combination of proper chemical composition and rolling condition.

The plug mill process is a process for producing a seamless steel pipe through the following steps: a piercing mill (which may be called as the first piercer)—a cross rolling mill (which may be called as the second piercer)—a plug mill—a reeler (which may be called as a reeling mill)—a sizer. The plug mill process is higher in productivity and yield and is less expensive in the production of seamless steel pipes than the Ugine.Sé journet process.

An explanation will be made with respect to the reason of the limitation of the chemical composition of the duplex stainless steel of the present invention.

C:

C is an element incidentally contained in steel. When the C content in a steel exceeds 0.03%, the steel is poor in corrosion resistance and in resistance against grain boundary corrosion. Therefore, the C content is limited to not more than 0.03%.

Si:

Si is an element used as a deoxidizer at the melting of steel. However, when the Si content in a steel exceeds 2.0%, the $\alpha$ phase is developed, and the steel is very poor in cold workability. Therefore, the Si content is limited to not more than 2.0%.

Mn:

Mn is added to steel in order to improve its strength. However, a steel containing more than 2.0% of Mn is poor in workability. Therefore, the Mn content is limited to not more than 2.0%.

Cr:

Cr is an indispensable element in order to improve the corrosion resistance of steel and to form a duplex texture consisting of austenite and ferrite in steel. When the Cr content in a steel is less than 20%, the effect of Cr is poor in giving to the steel resistances against pitting corrosion and crevice corrosion. The pitting corrosion resistance increases corresponding to the increase of the Cr content. However, when the Cr content in a steel exceeds 30.0%, the $\sigma$ phase is apt to be easily precipitated in the steel and the steel is poor in toughness. Therefore, the Cr content is limited to 20.0-30.0%.

Ni:

Ni is an indispensable element for improving the resistance against general corrosion of steel and for forming a duplex texture in steel. However, less than 1.0% of Ni content in a steel can not give to the steel a satisfactorily high resistance against corrosion. While, when the Ni content in a steel exceeds 9.0%, the effect of Ni is saturated. Moreover, Ni is an expensive element. Accordingly, the Ni content is limited within the range of 1.0-9.0%.

Cu:

Cu improves the corrosion resistance of steel against non-oxidizing acid, but a steel containing more than 3.0% is poor in hot workability. Therefore, the Cu content is limited to not more than 3.0%.

Mo:

Mo is an element, which improves the resistance of steel against the local corrosion in a corrosion environment containing chlorine ion. However, a steel containing less than 0.5% of Mo has not a satisfactorily high corrosion resistance; while even when more than 5.0% of Mo is contained in a steel, the effect of Mo for improving the corrosion resistance of the steel does not so increase. Moreover, Mo is very expensive. Therefore, the Mo content is limited within the range of 0.5-5.0%.

N:

N is an important element in order to form a duplex texture in steel, and further serves to increase the corrosion resistance of steel. However, a steel containing less than 0.05% of N has not a satisfactorily high resistance against pitting corrosion; while a steel containing more than 0.30% of N has a very poor hot workability. Therefore, the N content is limited within the range of 0.05-0.30%.

Al:

Al is an effective element for decreasing the amount of oxygen contained in a steel, which oxygen deteriorates the hot workability of the steel of the present invention. However, an Al content of less than 0.01% in a steel can not decrease the oxygen content in the steel in order to improve its hot workability. While, when an Al content in a steel is more than 0.10%, the surface defects of the steel due to alumina cluster is increased. Therefore, the Al content is limited within the range of 0.01-0.10%.

S:

S is contained in a steel as an incidental impurity, and deteriorates the hot workability of the steel of the present invention. The adverse affect of S appears particularly noticeably at the production of pipe through the plug mill process. When S is contained in a steel in an amount of more than 0.004%, it is difficult to produce pipes without causing defects even in the addition of rare earth metal (hereinafter, referred to a REM), Ca and the like, which metals are effective for fixing sulfides. Therefore, the S content is limited to not more than 0.004%.

P:

P is contained in steel as an incidental impurity. When P is contained in a steel in an amount of more than 0.030%, it is difficult to produce pipes without causing defects in the pipes by the plug mill process. Therefore, the P content is limited to not more than 0.030%.

The duplex stainless steel of the present invention contains the above described C, Si, Mn Cr, Ni, Cu, Mo, N, Al, S and P as basic components in the above limited amounts. Further, it is necessary that the duplex stainless steel of the present invention contain at least one of Ca and B in the following amounts concurrently with the above described basic components in order to improve the hot workability. The reason of the limitation of the amounts of these elements is as follows.

Ca:

Ca is a powerful sulfide-forming element, and is effective for decreasing the amount of S solid-solved in a steel and for improving the hot workability of the steel by forming its sulfide. However, when the amount of Ca is within the range of Ca<[%S], the effect is low; while, when the amount of Ca is within the range of Ca>10×[%S], the effect is saturated, and further there is a risk of increasing the surface defects due to the formation of oxide or sulfide of Ca. Therefore, the Ca content is limited within the range of Ca: (1–10)×[%S].

B:

B is effective for improving the hot workability of a steel by adding a slight amount of B to the steel. However, when the amount of B is less than 0.0005%, the effect does not appear; while, when the amount exceeds 0.010%, the hot workability of the steel is lowered. Therefore, the B content is limited within the range of 0.0005–0.010%.

Hereinafter, an explanation will be made with respect to the reason of the limitations of the production condition of a duplex stainless steel seamless pipe having the above described composition by the plug mill process.

In the piercing step, the temperature of the center portion and outer surface portion of a billet are limited within the ranges of 1,200°–1,350° C. and 1,100°–1,350° C. respectively based on the following reason. Defects are apt to be formed in the center portion of a billet due to the Mannesmann effect even in the case where the billet has a chemical composition defined in the present invention, and hence the center portion of a billet must be kept to a temperature not lower than 1,200° C. in order to pierce the billet without forming defects in the center portion. However, even when the temperature of the center portion exceeds 1,350° C., defects are formed in the center portion. Accordingly, the temperature of the center portion of a billet is limited within the range of 1,200°–1,350° C. The outer surface portion of a billet is not subjected to a working under so severe condition as that applied to the center portion of the billet, but when the temperature of the outer surface portion of a billet is lower than 1,100° C., defects are formed in the outer surface portion; while even when the temperature is higher than 1,350° C., defects are also formed. Accordingly, the temperature of the outer surface portion of a billet is limited within the range of 1,100°–1,350° C.

The reason why the cross rolling in the cross rolling step is finished at a temperature not lower than 1,100° C. will be explained hereinafter. In the beginning stage of the investigation of the present invention, when a hollow piece was cross rolled at a temperature of 1,000° C., the hollow piece cracked. When a hollow piece was cross rolled at a temperature of 1,080° C., although the hollow piece did not crack in the cross rolling step, the piece cracked in the next step of rolling by means of a plug mill in spite of the fact that the plug mill rolling was carried out at a low reduction rate. It can be seen from this fact that the strain caused in a hollow piece by plastic working during the cross rolling has a high influence upon the rolling by the plug mill. When the cross rolled hollow piece is reheated to eliminate the strain by plastic working, the adverse affect of the strain can be obviated. However, such reheating is not advantageous in view of the energy saving demanded at present.

The inventors have made experiments and investigations in order to find out a method for rolling a cross rolled hollow piece without carrying out the reheating. That is, a simulation experiment was effected in a laboratory scale by means of a hot tensile tester.

In the cold working, there is commonly carried out a method, wherein an equivalent stress and an equivalent strain are defined, and a stressed state of a steel during various workings is calculated from the uniaxial strain-hardening curve of the steel. However, in the hot working, recrystallization occurs during the hot working, and therefore the conception of equivalent strain is used in order to evaluate quantitatively the working state of a steel in the hot working.

The experimental method will be explained in detail hereinafter. In general, an equivalent strain caused in a steel at the cross rolling and calculated by the formula (1) is about 0.7. Accordingly, the value of prestrain $|\ln(A/A_o)|$ in the hot tensile test was assumed to be 0.7, wherein $A_o$ is the cross-sectional area of a test piece before the test, and A is the cross-sectional area thereof after applied with a prestrain.

That is, according to the working schedule shown by a diagram in FIG. 1, after a test piece was heated and kept at 1,250° C., the test piece was cooled to a given temperature $T_1$, kept at this temperature $T_1$ for $t_1$ seconds to give a prestrain ($W_1$) to the test piece. The test piece was then cooled to a given temperature $T_2$, kept at this temperature $T_2$ for $t_2$ seconds, and then subjected to a tensile test $W_2$.

Figure 2:
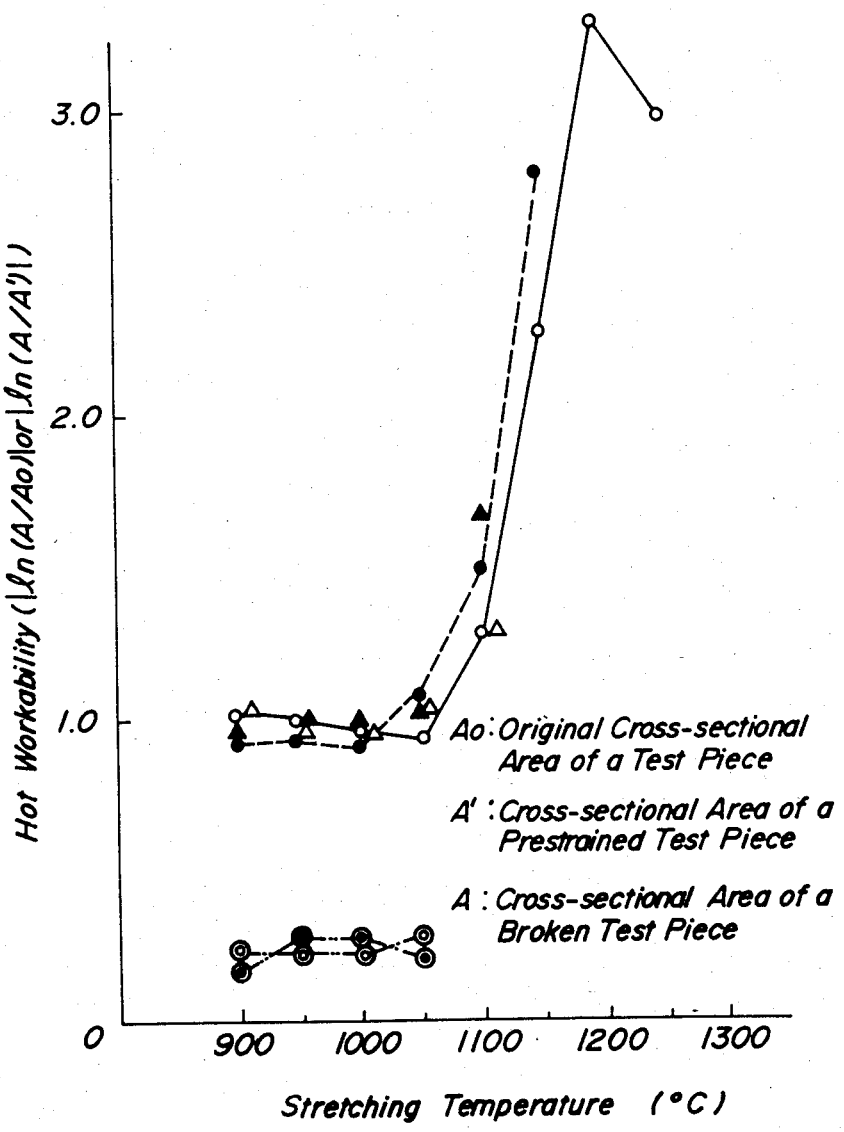
FIG. 2 is a graph illustrating a relation between the stretching temperature and the hot workability of a test piece measured by means of a hot tensile tester in a case where a prestrain is applied to the test piece at a given temperature and then the test piece is stretched at a temperature lower than the prestrained temperature.

FIG. 2 illustrates the results of the test. That is, a test piece produced from a steel having a chemical composition shown in the following Table 1 was used and the test piece was treated under conditions shown in the following Table 2.

TABLE 1

| Chemical composition (wt. %) | | | | | | | | | | |
|---|---|---|---|---|---|---|---|---|---|---|
| C | Si | Mn | P | S | CR | Ni | Cu | N | Al | Ca |
| 0.014 | 0.51 | 1.02 | 0.025 | 0.003 | 22.0 | 5.5 | 1.2 | 0.15 | 0.07 | 0.0065 |

TABLE 2

| Prestrain | | | Retention time (seconds) 0 | 50 |
|---|---|---|---|---|
| Prestrained | Temperature (°C.) | 1,200 | ● | |
| | | 1,125 | Δ | Δ |
| | | 1,050 | ○ | ◉ |
| Not prestrained | | | | |

It can be seen from FIG. 2 that, when a prestrain is given to the steel at a temperature not higher than 1,050° C., and the prestrained steel is stretched at a temperature lower than the prestraining temperature, the hot workability of the steel represented by its elongation at break of $|\ln(A/A')|$, wherein A' is the cross-sectional area of the prestrained test piece, and A is the cross-sectional area of the broken test piece, is remarkably lower than the hot workability of the case where the steel is not prestrained. Even when the steel is prestrained at a temperature not lower than 1,100° C. and the prestrained steel is stretched at a temperature lower than the prestraining temperature, the elongation at break of the steel is substantially the same as the case where the steel is not prestrained. That is, a prestrain applied to a steel at a temperature not lower than 1,100° C. does not adversely influence the working of the steel in the subsequent steps. That is, when a cross rolling of a hollow piece is carried out at a temperature lower than 1,100° C., the low temperature cross rolling has an adverse influence upon the subsequent rollings by a plug mill, a reeler and a sizer, and hence the rolling of the hollow piece in these steps, which in itself is difficult due to the lowering of the temperature, becomes more difficult. Due to the reason, the temperature in the cross rolling is limited to not lower than 1,100° C. Further, it can be seen from the result of this experiment that, when a billet is pierced at a temperature not lower than 1,100° C., the strain caused in the resulting hollow piece by plastic working during the piercing has not an adverse influence upon the cross rolling of the hollow piece.

The reason why the equivalent strain which will be caused in a hollow piece in the plug mill rolling step is limited to not higher than 0.5 is as follows. When the equivalent strain exceeds 0.5, the hollow piece cracks during the plug mill rolling; or even when the hollow piece does not crack during the plug mill rolling, defects are formed in the hollow piece in the sebsequent reeling step even in the case where the hollow piece is rolled in a small amount in the reeling step. Based on this reason, the equivalent strain, which will be caused in the hollow piece in the plug mill rolling step, is limited to not higher than 0.5. When a hollow piece does not crack during the plug mill rolling, but defects are formed in the hollow piece during the subsequent reeling step, the formation of the defects can be prevented by reheating the hollow piece after the plug mill rolling. However, some energy is required for the reheating, resulting in a high production cost of pipe. Accordingly, when the equivalent strain which will be caused in a hollow piece in the plug mill rolling step is limited to not higher than 0.5, the reheating is not necessary, and a pipe can be produced inexpensively.

The reason why the equivalent strain which will be caused in a hollow piece in the reeling step is limited to not higher than 0.4 will be explained hereinafter. In order to produce a pipe having a dimension which agrees with the demand of users, it is impossible to omit the plug mill rolling step. In the present invention, the cross rolling is carried out at a temperature not lower than 1,100° C., and the plug mill rolling must be carried out at a temperature lower than the cross rolling temperature. As clearly understood from FIG. 2, a working at a temperature lower than 1,100° C. has a high influence upon the working in the subsequent step. The worked amount of a hollow piece in the plug mill rolling step has a high influence upon the rolling of the hollow piece in the reeling step, and therefore the amount of a hollow piece to be worked in the reeling step must be determined by taking into consideration the worked amount of the hollow piece in the plug mill rolling step. When a hollow piece is worked in the plug mill rolling step in an amount necessary for producing a pipe having a dimension which agrees with the demand by the users, there is a risk of formation of defects in the hollow piece in the reeling step. As the result of experiments and investigations, the inventors have found out that, when a hollow piece is rolled in the reeling step under a condition that the equivalent strain which will be caused in the hollow piece exceeds 0.4, the hollow piece cracks in the reeling step, and therefore the amount of a hollow piece to be worked in the reeling step is limited to such an amount that will cause an equivalent strain of not higher than 0.4 in the hollow piece.

An explanation will be made hereinafter the reason why the total amount of equivalent strain which will be caused in a hollow piece in the plug mill rolling step and in the reeling step is limited to not higher than 0.6, and further the equivalent strain which will be caused in the hollow piece in the outer diameter reducing step is limited to not higher than 0.2 in the second aspect of the present invention. When the total amount of the equivalent strain caused in a hollow piece in the plug mill rolling step and in the reeling step exceeds 0.6, defects are formed in the hollow piece during its working in the outer diameter reducing step by the sizer even in the case where defects are not formed in the hollow piece in the reeling step. While, even when the total amount of the equivalent strain is not higher than 0.6, if the hollow piece is rolled by a sizer under a condition that the equivalent strain caused in the hollow piece exceeds 0.2, defects are formed in the hollow piece during the rolling by the sizer. Therefore, in the second aspect of the present invention, the total amount of the equivalent strain which will be caused in the hollow piece in the plug mill rolling step and in the reeling step is limited to not higher than 0.6, and the equivalent strain which will be caused in the hollow piece in the outer diameter reducing step by the sizer is limited to not higher than 0.2.

An explanation will be made with respect to the reheating of a reeled hollow piece, and the amount of the reheated hollow piece to be worked in the outer diameter reducing step by the sizer in the third aspect of the present invention. When a reeled hollow piece is rolled at a temperature not lower than 850° C. by a sizer in the outer diameter reducing step, the $\sigma$ phase is apt to form in the reeled hollow piece and the working of the hollow piece by the sizer becomes difficult. Even when the rolling temperature of a reeled hollow piece by the sizer is not lower than 850° C., if the reeled hollow piece is kept to this temperature for a period longer than 10 minutes, the $\sigma$ phase is apt to be formed, and the working of the reeled hollow piece by the sizer is difficult. It is not necessary to heat a reeled hollow piece at a temperature higher than 1,200° C., and a reheating at a lower temperature is desirable in view of energy saving. Further, when a reheated hollow piece is rolled under a condition that the equivalent strain which will be caused in the hollow piece, is higher than 0.4, the hollow piece buckles along its peripheral direction. Based on the above described reason, the treating condition of a reeled hollow piece is limited such that the reeled hollow piece is heated at a temperature of 850°–1,200° C. for a period of not longer than 10 minutes, and then the reheated hollow piece is worked by the sizer under a condition that the equivalent strain which will be caused in the hollow piece is kept to not higher than 0.4.

The following example is given for the purpose of illustration of this invention and is not intended as a limitation thereof.

EXAMPLE

Pipes having a chemical composition shown in the following Table 3 were produced under a production condition shown in Table 3. The obtained results are shown in Table 3 together with the composition and production condition. In Table 3, items which do not satisfy the requirements defined in the present invention are indicated by underline. In Sample No. 1 of comparative example, the steel did not contain Ca and B, and hence the hollow piece cracked during the cross rolling. In Sample Nos. 2, 3 and 4 of comparative example, the content of Ca or B in the steel was lower than the lower limit or was higher than the upper limit defined in the present invention, and hence the hollow piece cracked during the working by the reeler. In Sample Nos. 5 and 6 of comparative example, the S content exceeded the upper limit defined in the present invention, and hence the hollow piece cracked during the cross rolling. In Sample Nos. 7, 8 and 9 of comparative example, the temperature of the outer surface portion of the billet in the piercing step was lower or higher than the lower limit or higher limit defined in the present invention, and hence the hollow piece cracked at its outer surface during the piercing. In Sample Nos. 10 and 11 of comparative example, the temperature of the hollow piece in the cross rolling step is lower than the lower limit defined in the present invention, the hollow piece cracked during the cross rolling. In Sample Nos. 12, 13, 14 and 15 of comparative example, the equivalent strain, which was caused in a hollow piece in the plug mill rolling step, reeling step or outer diameter reducing step, is higher than the upper limit defined in the present invention, and hence the hollow piece cracked during the working in respective steps. In Sample No. 16 of comparative example, the reheating temperature of the reeled hollow piece was lower than the lower limit defined in the present invention; and in Sample No. 17 of comparative example, the reheating temperature of the reeled hollow piece was higher than the upper limit defined in the present invention; and therefore the reeled hollow pieces of Sample Nos. 16 and 17 cracked during the working by means of a sizer. In Sample No. 18 of comparative example, the equivalent strain caused in the reeled hollow piece during the working by the sizer was higher than the upper limited defined in the present invention, and therefore the reeled hollow piece was buckled during the working by the sizer.

On the contrary, in Sample Nos. 19–25 of the present invention, all the requirements defined in the present invention were satisfied, and therefore pipes were able to be produced without causing cracks in respective steps.

TABLE 3

| | Sample No. | Chemical composition (wt. %) C | Si | Mn | P | S | Ni | Cr | Mo | Cu | N | Al | REM | Ca | B | Temperature of the surface portion of a billet in the piercing step (°C.) | Temperature of the center portion of a billet in the piercing step (°C.) |
|---|---|---|---|---|---|---|---|---|---|---|---|---|---|---|---|---|---|
| Comparative example | 1 | 0.015 | 0.51 | 1.03 | 0.021 | 0.003 | 6.0 | 25.1 | 3.0 | 1.2 | 0.17 | 0.05 | — | — | — | 1,120 | 1,250 |
| | 2 | 0.013 | 0.49 | 1.01 | 0.023 | 0.003 | 6.0 | 25.0 | 3.0 | 1.1 | 0.16 | 0.06 | — | 0.002 | — | 1,120 | 1,250 |
| | 3 | 0.015 | 0.51 | 1.03 | 0.022 | 0.004 | 6.1 | 25.0 | 3.0 | 1.2 | 0.16 | 0.07 | — | 0.06 | — | 1,120 | 1,250 |
| | 4 | 0.016 | 0.48 | 1.02 | 0.024 | 0.003 | 6.0 | 25.0 | 3.0 | 1.1 | 0.17 | 0.06 | — | — | 0.0004 | 1,120 | 1,250 |
| | 5 | 0.015 | 0.52 | 1.01 | 0.021 | 0.005 | 6.1 | 25.1 | 3.0 | 1.1 | 0.16 | 0.07 | — | 0.025 | — | 1,110 | 1,250 |
| | 6 | 0.013 | 0.50 | 1.02 | 0.023 | 0.005 | 6.0 | 25.0 | 3.1 | 1.2 | 0.16 | 0.06 | — | — | 0.004 | 1,115 | 1,250 |
| | 7 | | | | | | | | | | | | | | | 1,050 | 1,250 |
| | 8 | | | | | | | | | | | | | | | 1,050 | 1,180 |
| | 9 | | | | | | | | | | | | | | | 1,200 | 1,360 |
| | 10 | | | | | | | | | | | | | | | 1,120 | 1,250 |
| | 11 | | | | | | | | | | | | | | | 1,120 | 1,250 |
| | 12 | 0.013 | 0.51 | 1.02 | 0.022 | 0.003 | 6.0 | 25.2 | 3.0 | 1.2 | 0.17 | 0.07 | — | 0.006 | — | 1,120 | 1,250 |
| | 13 | | | | | | | | | | | | | | | 1,210 | 1,250 |
| | 14 | | | | | | | | | | | | | | 1,120 | 1,250 | |
| | 15 | | | | | | | | | | | | | | | 1,120 | 1,250 |
| | 16 | | | | | | | | | | | | | | | 1,120 | 1,250 |
| | 17 | | | | | | | | | | | | | | | 1,120 | 1,250 |
| | 18 | | | | | | | | | | | | | | | 1,120 | 1,250 |
| Present invention | 19 | 0.013 | 0.49 | 1.01 | 0.021 | 0.001 | 6.0 | 25.1 | 3.1 | 1.2 | 0.15 | 0.07 | — | 0.004 | — | 1,120 | 1,250 |
| | 20 | | | | | | | | | | | | | | | 1,120 | 1,250 |
| | 21 | 0.013 | 0.50 | 1.02 | 0.023 | 0.003 | 6.0 | 25.1 | 3.0 | 1.2 | 0.17 | 0.06 | — | 0.012 | — | 1,120 | 1,250 |
| | 22 | 0.014 | 0.49 | 1.02 | 0.021 | 0.003 | 6.1 | 25.0 | 3.1 | 1.2 | 0.17 | 0.07 | — | — | 0.004 | 1,120 | 1,250 |
| | 23 | 0.014 | 0.50 | 1.01 | 0.022 | 0.003 | 6.0 | 25.2 | 3.1 | 1.2 | 0.16 | 0.03 | 0.012 | 0.006 | — | 1,120 | 1,250 |
| | 24 | 0.014 | 0.50 | 1.01 | 0.023 | 0.003 | 6.2 | 25.0 | 3.0 | 1.2 | 0.17 | 0.02 | 0.014 | — | 0.003 | 1,120 | 1,250 |
| | 25 | 0.014 | 0.51 | 1.01 | 0.023 | 0.001 | 7.5 | 28.0 | 3.0 | 1.2 | 0.15 | 0.05 | — | — | 0.002 | 1,120 | 1,250 |

| | Sample No. | Temperature of a hollow piece in the cross rolling step (°C.) | Equivalent strain: Plug mill rolling step | Reeling step | Total | Outer diameter reducing step | Reheating: Temp. (°C.) | Time (min.) | Remarks |
|---|---|---|---|---|---|---|---|---|---|
| Comparative example | 1 | 1,100 | | | | | | | Cracked in cross rolling step |
| | 2 | 1,100 | 0.37 | 0.19 | | | | | Cracked in reeling step |
| | 3 | 1,100 | 0.37 | 0.19 | | | | | Cracked in reeling step |
| | 4 | 1,100 | 0.37 | | | | | | Cracked in the first pass in plug mill rolling step |
| | 5 | 1,100 | | | | | | | Cracked in cross rolling step |
| | 6 | 1,100 | | | | | | | Cracked in cross rolling step |

TABLE 3-continued

| | | | | | | | | | |
|---|---|---|---|---|---|---|---|---|---|
| | 7 | | | | | | | | Cracked in the outer surface in piercing step |
| | 8 | | | | | | | | Cracked in the inner and outer surfaces in piercing step |
| | 9 | | | | | | | | Cracked in the inner surface in piercing step |
| | 10 | 1,050 | | | | | | | Cracked in cross rolling step |
| | 11 | 1,080 | 0.37 | | | | | | Cracked in plug mill rolling step |
| | 12 | 1,100 | 0.60 | | | | | | Cracked in plug mill rolling step |
| | 13 | 1,120 | 0.37 | 0.40 | 0.77 | | | | Cracked in reeling step |
| | 14 | 1,120 | 0.37 | 0.29 | 0.66 | 0.2 | | | Cracked in outer diameter reducing step |
| | 15 | 1,120 | 0.22 | 0.19 | 0.41 | 0.3 | | | Cracked in outer diameter reducing step |
| | 16 | 1,100 | 0.37 | 0.29 | 0.66 | 0.2 | 800 | 5 | Cracked in outer diameter reducing step |
| | 17 | 1,100 | 0.37 | 0.29 | 0.66 | 0.2 | 900 | 15 | Cracked in outer diameter reducing step |
| | 18 | 1,100 | 0.37 | 0.29 | 0.66 | 0.5 | 900 | 10 | Buckled in outer diameter reducing step |
| Present invention | 19 | 1,120 | 0.22 | 0.19 | 0.41 | 0.2 | | | Hollow piece did not crack in respective steps for the production of pipe |
| | 20 | 1,120 | 0.37 | 0.29 | 0.66 | 0.3 | 950 | 5 | |
| | 21 | 1,100 | 0.22 | 0.19 | 0.41 | 0.2 | | | |
| | 22 | 1,100 | 0.22 | 0.19 | 0.41 | 0.2 | | | |
| | 23 | 1,100 | 0.37 | 0.15 | 0.52 | 0.2 | | | |
| | 24 | 1,120 | 0.37 | 0.29 | 0.66 | 0.2 | 950 | 5 | |
| | 25 | 1,120 | 0.37 | 0.29 | 0.66 | 0.2 | 950 | 5 | |

Note:
Temperature was measured by inserting a thermocouple into the center portion of a billet.

As clearly understood from the above described example, according to the present invention, the composition of a duplex stainless steel was limited, the billet temperatures in the piercing step and cross rolling step were limited, the equivalent strains which would be caused in the hollow piece in the plug mill rolling step, reeling step and outer diameter reducing step were limited, and occasionally the reheating temperature was limited, whereby a duplex stainless steel seamless pipe was able to be produced in high productivity and yield.

What is claimed is:

1. A method of producing a duplex stainless steel seamless pipe having a composition consisting of, in % by weight, C: not more than 0.03%, Si: not more than 2.00%, Mn: not more than 2.00%, Cr: 20.0–30.0%, Ni: 1.0–9.0%, Cu: not more than 3.0%, Mo: 0.5–5.0%, N: 0.05–0.30%, Al: 0.01–0.10%, S: not more than 0.004%, P: not more than 0.030%, at least one of Ca: (1–10)×[%S] and B: 0.0005–0.010%; and the remainder being Fe and incidental impurities by a plug mill process comprising a piercing step by means of a piercing mill, a cross rolling step by means of a cross rolling mill, a rolling step by means of a plug mill, a reeling step by means of a reeler and an outer diameter reducing step by means of a sizer, wherein a billet is pierced in the piercing step under a condition that the billet is kept at a temperature of 1,200°–1,350° C. in its center portion and at a temperature of 1,100°–1,350° C. in its outer surface portion; the cross rolling of the resulting hollow piece is finished at a temperature not lower than 1,100° C. in the cross rolling step; and the cross rolled hollow piece is worked in the plug mill rolling step, in the reeling step and in the outer diameter reducing step under conditions that the equivalent strains which will be caused in the hollow piece in the plug milling rolling step, in the reeling step and in the outer diameter reducing step are kept to not higher than 0.5, not higher than 0.4 and not higher than 0.2 respectively, said equivalent strains being calculated by the following formula (1), and that the total amount of the equivalent strain which will be caused in the hollow piece in the plug mill rolling step and in the reeling step is kept to not higher than 0.6, said total amount of the equivalent strain being calculated by the following formula (2):

$$\bar{\epsilon} = \frac{2}{\sqrt{3}} \sqrt{(\epsilon_t^2 + \epsilon_t \cdot \epsilon_B + \epsilon_B^2)} \quad (1)$$

wherein $\epsilon_t = \ln (t/t_o)$ $\epsilon_B = \ln (D/D_o)$ $t_o$, $D_o$: average wall thickness and average outer diameter of the hollow piece before rolling in each step, respectively t, D: average wall thickness and average outer diameter of the hollow piece after rolling in each step, respectively; and $$\bar{\epsilon'} = \frac{2}{\sqrt{3}} \sqrt{(\epsilon_t'^2 + \epsilon_t' \cdot \epsilon_B' + \epsilon_B'^2)} \quad (2)$$

wherein $\epsilon'_t = \ln (t_p/t_{po}) + \ln (t_R/t_{Ro})$ $\epsilon'_B = \ln (D_p/D_{po}) + \ln (D_R/D_{Ro})$ $t_p$, $t_{po}$: average wall thicknesses of the hollow piece after and before rolling by the plug mill, respectively $t_R$, $t_{Ro}$: average wall thicknesses of the hollow piece after and before rolling by the reeler, respectively $D_p$, $D_{po}$: average outer diameters of the hollow piece after and before rolling by the plug mill, respectively $D_R$, $D_{Ro}$: average outer diameters of the hollow piece after and before rolling by the reeler, respectively.

2. A method of producing a duplex stainless steel seamless pipe having a composition consisting of, in % by weight, C: not more than 0.03%, Si: not more than 2.00%, Mn: not more than 2.00%, Cr: 20.0–30.0%, Ni: 1.0–9.0%, Cu: not more than 3.0%, Mo: 0.5–5.0%, N: 0.05–0.30%, Al: 0.01–0.10%, S: not more than 0.004%, P: not more than 0.030%, at least one of Ca: (1–10)×[%S] and B: 0.0005–0.010%; and the remainder being Fe and incidental impurities by a plug mill process comprising a piercing step by means of a piercing mill, a cross rolling step by means of a cross rolling mill, a rolling step by means of a plug mill, a reeling step by means of a reeler and an outer diameter reducing step by means of a sizer, wherein a billet is pierced in the piercing step under a condition that the billet is kept at a temperature of 1,200°–1,350° C. in its center portion and at a temperature of 1,100°–1,350° C. in its outer surface portion; the cross rolling of the resulting hollow piece is finished at a temperature not lower than 1,100° C. in the cross rolling step; and the cross rolled hollow piece is worked in the plug mill rolling step and in the reeling step under a condition that the equivalent strains which will be caused in the hollow piece in the plug mill rolling step and in the reeling step are kept to not higher than 0.5 and not higher than 0.4 respectively, said equivalent strains being calculated by the following formula (1); the reeled hollow piece is reheated at a temperature of 850°–1,200° C. for a period of not longer than 10 minutes; and the reheated hollow piece is worked in the outer diameter reducing step under a condition that the equivalent strain which will be caused in the hollow piece in the step is kept to not higher than 0.4, said equivalent strain being calculated by the following formula (1):

$$\bar{\epsilon} = \frac{2}{\sqrt{3}} \sqrt{(\epsilon_t^2 + \epsilon_t \cdot \epsilon_B + \epsilon_B^2)} \quad (1)$$

wherein $\epsilon_t = \ln (t/t_o)$ $\epsilon_B = \ln (D/D_o)$ $t_o$, $D_o$: average wall thickness and average outer diameter of the hollow piece before rolling in each step, respectively t, D: average wall thickness and average outer diameter of the hollow piece after rolling in each step, respectively.

* * * * *